252-103 AU 157 EX
7/3/84 XR 4,457,760

United States Patent [19]
Cholley

[11] Patent Number: 4,457,760
[45] Date of Patent: Jul. 3, 1984

[54] PROCESS FOR DESIZING AND BLEACHING CLOTH WITH A HYDROGEN PEROXIDE-BASED BATH IN A SINGLE OPERATION

[75] Inventor: Jean-Marie Cholley, Paris, France

[73] Assignee: Produits Chimiques Ugine Kuhlmann, Paris, France

[21] Appl. No.: 335,100

[22] Filed: Dec. 28, 1981

[30] Foreign Application Priority Data

Dec. 31, 1980 [FR] France ..... 80 27866

[51] Int. Cl.³ ..... D06L 3/02; D06L 1/06; D06L 1/14; D06L 3/00

[52] U.S. Cl. ..... 8/111; 8/138; 252/103

[58] Field of Search ..... 8/111, 138; 252/103

[56] References Cited

U.S. PATENT DOCUMENTS 3,377,131 4/1968 Cerana ..... 8/107
3,579,454 5/1971 Collier ..... 8/111
3,595,603 7/1971 Cerana ..... 8/107
3,740,188 6/1973 Sitver et al. ..... 8/111
3,838,967 10/1974 Shepley ..... 8/111
4,195,974 4/1980 Kothe et al. ..... 8/138

FOREIGN PATENT DOCUMENTS 1267656 5/1968 Fed. Rep. of Germany ..... 8/138

OTHER PUBLICATIONS

Regan I, Jour. of the Soc. of Dyers & Colorists, vol. 78, No. 11, 11/62.

*Primary Examiner*—Maria Parrish Tungol
*Attorney, Agent, or Firm*—Brooks, Haidt, Haffner & Delahunty

[57] ABSTRACT

Processes for desizing and bleaching cloth in a single operation utilizing a bath containing hydrogen peroxide, sodium hydroxide, a sequestrant, an enzyme preparation based on a starch-degrading enzyme, and a surface active agent, such processes resulting in significant economies in usage of water and of steam, labor, and capital costs.

9 Claims, No Drawings

PROCESS FOR DESIZING AND BLEACHING CLOTH WITH A HYDROGEN PEROXIDE-BASED BATH IN A SINGLE OPERATION

BACKGROUND OF THE INVENTION

This invention relates to processes for treating textiles, and more particularly, it relates to processes for desizing and bleaching woven fabrics or similar goods based on textile fibers, in a single operation.

It is known that the preparation of fabrics made of cellulose fibers, by dyeing, printing and other finishing treatments, generally comprises the operations of desizing, boiling off, bleaching, and optionally mercerizing. The purpose of desizing is to eliminate the sizing products previously applied to the warp threads to improve their characteristics on the loom, as well as any products which may have been applied to the weft threads.

The sizing products applied to the threads before weaving may be based either on starch dispersions alone or in admixture with starches which have been more or less converted chemically, or on derivatives of polyvinyl alcohol, or polyacrylate derivatives or etherified cellulose. The sizing products may be retained to a greater or lesser extent in the fabric, depending on the drying temperature, the twisting of the threads and the texture of the fabric.

The presence of such sizes makes it impossible to obtain a uniform, solid shade during dyeing and printing with many dyes, and such sizes have to be eliminated before the dyeing or printing operations can be effected. For some fabrics intended for white sales, the removal of the size is also desirable to ensure that the treated goods are pleasant and supple to the touch. Desizing is generally effected by impregnation in an enzyme and surfactant bath heated to a temperature of between 60° C. and 75° C. The impregnated fabric may either be left to stand, or it may be steamed at a temperature of 100° C. It is then washed at 95° C., then at 60° C. and optionally in running water.

Boiling off, which is designed to saponify the greases in the cotton and solubilize the ligneous residues, is effected in a caustic soda medium at a temperature of between 100° C. and 140° C.

The purpose of bleaching is to oxidize the impurities which are a part of the unbleached or previously boiled off cotton, linen or other cellulose fiber. In virtually every case, it is carried out with oxidizing agents such as hydrogen peroxide, alkali peroxides and per-salts, peracetic acid, sodium hypochlorite, sodium chlorite, and the like.

The operations of desizing, boiling off and bleaching are generally carried out in an aqueous medium, with heat. Each operation is followed by hot and cold washes, resulting in considerable water and energy consumption.

THE INVENTION

The aim of the present invention is to reduce the number of operations for the preparation of fabric based on cellulose fibers, either alone or mixed with one another or with other regenerated or chemical fibers, such as viscoses, polyamides and polyesters, and the invention provides new processes wherein desizing and bleaching are combined in a single operation.

The processes of desizing and bleaching in a single operation according to the present invention are carried out in an aqueous bath containing hydrogen peroxide and an appropriate base such as an alkali metal sodium hydroxide. Optionally, a stabilizer such as sodium silicate, a sequestrant such as the sodium salt of diethylenetriamine pentacetic acid (DTPA), an enzyme preparation based on a starch-degrading enzyme and/or a surfactant can be included.

An enzymatic preparation suitable for use according to the present invention is, for example, that shown in German patent application No. P 29 09 396.7. It consists of an intimate mixture of a starch-degrading enzyme, such as amylase, and a non-ionic surfactant belonging to the group composed of alkyl and alkaryl oxalkylates in water. An appropriate enzymatic composition is, for example, composed of 10 to 40 parts of aqueous enzymatic preparation and 10 to 60 parts of a non-ionic surfactant. Particularly good results are obtained when using one of these enzymatic preparations sold under the name Enzylase C by Messrs. Diamalt.

A desirable single desizing-bleaching bath according to the present invention can contain:

| | |
|---|---|
| Hydrogen peroxide, 35% | 40–60 mL/L |
| Caustic soda | 6–7 g/L |
| Sequestering agent | 2–6 g/L |
| Enzylase C | 8–12 g/L |
| Surface active agent | 1–2 mL/L |

The process is desirably carried out as follows:

(1) Impregnating the fabric in the desizing and bleaching bath and squeezing out, so as to leave only the quantity of liquor necessary for the reaction in the fabric. This is generally between 60 and 120% of the weight of dry fabric, depending on the fabric in question.

(2) Steaming, to bring the fabric to the desired reaction temperature, generally between 20° and 120° C.

(3) Holding by rolling up or pleating the cloth in a J-Box, U-Box, carpet machine, or the like, for a period which can be varied from a few minutes to several hours.

The treatment is followed by successive washes at 90°–95° C., 60° C., and cold. The washing bath at 90°–95° C. can in certain embodiments advantageously contain added alkaline components, caustic soda, sodium carbonate, trisodium phosphate, and surface-active detergents.

One of the advantages of the process according to the present invention is that it does away with a wet desizing operation carried out at a minimum temperature of 60°–65° C., and several washing baths at temperatures of 90°–95° C.

The use of the process also does away with a "wet on wet" impregnation, that is, wet fabric being put into a bath containing the bleaching products. It is recognized that this treatment involves a number of operations, namely, preparation of a more concentrated bath and maintaining the impregnation bath at a constant level and concentration, all of which require either manual checking or automatic adjustment. To avoid "wet on wet" impregnation, some users adopt the procedure of an intermediate passage over a drying tenter, which involves the use of expensive equipment and a substantial energy consumption, particularly for heat.

The use of the process according to the invention therefore results in major savings in water, steam, labor and investment costs.

The characteristics of the fabric thus treated are excellent. They have a high degree of whiteness, virtually total elimination of the size, instant hydrophilism, and a satisfactory degree of polymerization.

The following Examples are given to illustrate embodiments of the invention as it is presently preferred to practice it. It will be understood that these Examples are illustrative, and the invention is not to be considered as restricted thereto except as indicated in the appended claims.

EXAMPLE I

A 182 cm wide cotton fabric with a weight of 195 g/m$^2$ and a 5.05 percent starch content is intended to be printed with reactive dyes and is found to have a reflectance of 55.3 percent, as measured with a No. 8 filter in a Zeiss Elrepho reflectometer at 457 nm wavelength. This unbleached cloth is directly impregnated with a bath containing:

| Ingredient | Amount |
|---|---|
| Caustic soda (as NaOH) | 4 g/L |
| D.O. stabilizer | 4 g/L |
| Hydrogen peroxide (35%) | 40 mL/L |
| Amylolytic enzyme (Enzylase C) | 10 g/L |
| Surface active agent (Ukanil 1036 wetting agent) | 1 mL/L |

The pH is desirably from 10 to 10.5.

The cloth is saturated with 106 percent of its own weight of the foregoing bath and steamed to bring it to a temperature of 95°-98° C. It is then rolled up in an insulated chamber where it is kept for one to two hours.

After this time, it is unrolled and continuously rinsed in a series of vats containing water at temperatures, respectively, of 95° C., 50°-60° C., and unheated. Following drying, the cloth has the following characteristics:

| | |
|---|---|
| Reflectance (Zeiss Elrepho) | 78.7 percent |
| Starch content | 0.07 percent |
| Hydrophilicity | Instantaneous |
| Polymerization index | 1650 |

EXAMPLE II

An unbleached 143 g/m$^2$, 100 percent cotton poplin with a 52.2 percent Elrepho reflectance, 7.6 percent starch content, and a polymerization index greater than 2700 is directly impregnated with a desizing-bleaching bath containing:

| | |
|---|---|
| Caustic soda (as NaOH) | 4 g/L |
| D.O. stabilizer | 4 g/L |
| Hydrogen peroxide (35%) | 40 mL/L |
| Amylolytic enzyme (Enzylase C) | 10 g/L |
| Wetting agent (Ukanil 1036) | 1 mL/L |

-continued

| |
|---|
| The pH is about 10-10.5. |

After steaming at 95° C., the impregnated cloth is rolled up in an insulated chamber and held for a one- to two-hour reaction time.

After continuous washing and drying, the cloth is found to have the following properties:

| | |
|---|---|
| Reflectance (Elrepho) | 77.5 percent |
| Residual starch content | 0.6 percent |
| Polymerization index | 1350 |

EXAMPLE III

A raw 100 percent cotton 166 g/m$^2$ fabric with a Zeiss Elrepho reflectance of 51.9 percent, a starch content of 3.55 percent, and a polymerization index greater than 2700 is treated as in the preceding Example. The bleached fabric has the following properties:

| | |
|---|---|
| Elrepho reflectance | 79.2 percent |
| Residual starch | 0.32 percent |
| Polymerization index | 1380 |

Unless otherwise indicated, all parts, percentages, proportions, and ratios herein are by weight.

What is claimed is:

1. A process for desizing and bleaching cellulosic fabrics in a single operation, which process comprises impregnating cellulosic cloth wih a basic desizing-bleaching composition containing hydrogen peroxide, a starch-degrading enzyme, and an alkali metal hydroxide.

2. A process according to claim 1 wherein the desizing-bleaching composition includes a sequestering agent.

3. A process according to claim 1 wherein the desizing-bleaching composition includes a surface active agent.

4. A process according to claim 1 carried out at a temperature of from 20° to 120° C.

5. A process according to claim 1 wherein the cloth is impregnated with the desizing-bleaching composition and the impregnated cloth is then squeezed to provide an amount of composition in the cloth of from about 60 to 120 percent of the weight of the fabric.

6. A process according to claim 1 wherein the fabric is steamed to raise its temperature to about 20° C. to 120° C.

7. A process according to claim 1 wherein the fabric is held in contact with the composition for from five minutes to four hours.

8. A process according to claim 1 wherein the alkali metal hydroxide is sodium hydroxide.

9. A desizing-bleaching composition consisting essentially of an aqueous mixture containing hydrogen peroxide (35%), 40-60 mL/L; caustic soda, 6-7 g/L; sequestering agent, 2-6 g/L; amylolytic enzyme, 8-12 g/L; and surface active agent, 1-2 mL/L.

* * * * *